US006976669B2

(12) United States Patent
Van Zijll Langhout et al.

(10) Patent No.: US 6,976,669 B2
(45) Date of Patent: Dec. 20, 2005

(54) SELF-SEALING VALVE

(75) Inventors: Jaco Matthijs Van Zijll Langhout, Den Haag (NL); Arnoldus Willem Zweekhorst, Delfgauw (NL)

(73) Assignee: Vacu Vin Innovations Ltd., Gibraltar (GE)

( * ) Notice: Subject to any disclaimer, the term of this patent is extended or adjusted under 35 U.S.C. 154(b) by 96 days.

(21) Appl. No.: 10/363,629

(22) PCT Filed: Sep. 5, 2001

(86) PCT No.: PCT/NL01/00654

§ 371 (c)(1),
(2), (4) Date: Oct. 9, 2003

(87) PCT Pub. No.: WO02/30782

PCT Pub. Date: Apr. 18, 2002

(65) Prior Publication Data

US 2005/0173668 A1 Aug. 11, 2005

(30) Foreign Application Priority Data

Sep. 5, 2000 (NL) ..... 1016109

(51) Int. Cl.[7] ..... B65D 51/16

(52) U.S. Cl. ..... 251/342; 215/228; 215/260; 215/262; 215/270; 215/311; 220/231; 141/65

(58) Field of Search ..... 215/228, 260, 215/262, 270, 311; 220/231; 141/65; 251/341, 251/342

(56) References Cited

U.S. PATENT DOCUMENTS

| | | | | |
|---|---|---|---|---|
| 1,907,358 | A | 5/1933 | Kuehne | |
| 2,128,128 | A | 8/1938 | Evans | |
| 3,578,221 | A | 5/1971 | Lukesch et al. | |
| 3,976,216 | A | 8/1976 | Lambert | |
| 3,977,575 | A | 8/1976 | Macquire-Cooper | |
| 4,003,489 | A | 1/1977 | Bingaman | |
| 4,410,110 | A | 10/1983 | Del Bon et al. | |
| 4,845,819 | A | 7/1989 | Kyomen et al. | |
| 5,465,857 | A * | 11/1995 | Yang | 215/228 |

* cited by examiner

*Primary Examiner*—J. Casimer Jacyna
(74) *Attorney, Agent, or Firm*—Young & Thompson

(57) ABSTRACT

Shut-off valve, composed of a container (3) provided with valve seat (4), and also a valve body (2, 22, 42) that can be moved through the opening bounded by the valve seat (4), in order to provide a seal. The valve body (2, 22, 42) is provided with a conical or spherical shut-off edge and is connected to the container (3) by way of a flexible connecting part (5). This makes it possible to move the valve body (2, 22, 42) laterally, in other words perpendicular to the direction of closing, and in this way achieve an opening of the shut-off valve. The container (3) can comprise any construction known in the prior art.

19 Claims, 4 Drawing Sheets

SELF-SEALING VALVE

BACKGROUND OF THE INVENTION

The present invention relates to a valve body, comprising a plug-shaped closing part with a closing face, and a fixing part which surrounds the closing part and is hingedly connected to the fixing part near the closing part.

DESCRIPTION OF THE RELATED ART

Such a valve body, combined with a valve seat, is known from U.S. Pat. No. 1,907,358. The closing part is of spherical near the free end, in order to engage with a valve seat face. On the other side, the closing part is provided with a plate which (in the use position) extends horizontally. This horizontally extending plate is hingedly connected near one side to a fixing structure, and is provided with a spring near the other side. This valve functions as an excess pressure relief valve or a blow-off safety device.

Shut-off valves that are intended for maintaining vacuum inside a container such as a jar, can or bottle are known in the prior art. An example is the shut-off valve shown in European Patent 0234607 in the name of Vacu Products. This patent discloses a part made of a relatively soft material and provided with a slit-shaped opening. Such a shut-off valve is intended particularly for vacuum applications and through the vacuum applied, the opposite edges bounding the slit will be pressed against each other. A shut-off valve is opened by applying a clamping force in a direction perpendicular to the direction of the slit, with the result that the slit is forced open. Although such a shut-off valve functions well, it requires a relatively large quantity of material, and it also has a relatively seat structural height.

SUMMARY OF THE INVENTION

It is the aim of the present invention to provide a more compact design for a shut-off valve, with low height, by means of which it is still easily possible to undo the shutting off effect of the shut-off valve.

This aim is realised with a abut-off valve of the type described above in that an extension acting as an operating part is fitted on the closing part in the direction away from the closing face, and in that said hinged connection to the fixing part is designed in such a way that on engagement upon the operating part the dosing face carries out a tilting movement.

According to the invention, the opening movement of the valve body is achieved in an extremely simple manner by tilting of the plug-shaped closing part by means of the operating part. The operating part is fitted in line with the closing part. Such a construction is extremely simple to produce and is likewise extremely simple to operate.

According to the invention, merely moving the valve body in the "lateral" direction relative to the valve seat, or the container, is sufficient to open the shut-off valve. In other words, the tilting movement of the shutoff face (theoretically, shutoff edge) is in fact carried out about a point lying on the longitudinal axis of the closing part-operating means. In the normal position this antis will be a vertical line. This means that a movement of the valve body from the valve seat is caused by tilting and/or deformation. This is achieved by the flexible connecting part between the valve body and the container. It will be understood that the valve seat can be integral with the container and be made of the same material. The contact face with the valve body, in other words the boundary edge of the opening to be shut off; can be conical or rectangular, or can be of any other shape known in the prior art. It will be understood that the container can comprise any construction known in the prior art. Non-limiting examples that can be mentioned are containers into which vacuum bas to be introduced. Such boxes or cans are generally provided with a lid, and the container described above can form part of said lid, in other words can be integral with it. However, the shut-off valve described above can also be used on bottles and the like. In such a case the container can be a separate part, but it could also comprise the neck of the bottle in question. In general, the shut-off valve according to the present invention will be used primarily in applications in which the creation of a vacuum is important. If the connection between valve body and the container is a part that is closed all the way round, it is important to provide a further opening through which air or gas can be moved. The fact is that the opening arising when the valve body is moved relative to the valve seat must be brought into communication with the environment or some other construction. Such other construction can comprise, for example, a vacuum pump. Whole a vacuum pump is used, the valve body will be moved in a direction substantially perpendicular to the opening face of the valve seat during the evacuation. If removal of the vacuum is desired at a later stage, the vacuum can be removed simply by pressing the valve body away laterally, in which case air from the environment is supplied through the opening described above.

The valve body can be provided with a part that projects above the connection to the connecting part. The user can act upon the tatter in order to open the shut-off valve. Since the various parts can be extremely compact embodied, an extremely compact construction can be obtained in this way. This is important, for example, if various containers have to be stacked on top of one another. In that case it is possible for the container that is to be stacked to have in the center a recess of small size, sufficiently large to receive the shut-off valve according to the invention on a recess lying below it.

If the connection between valve body and container is closed and an opening is present, in either the container or said connection, the opening characteristic and closing characteristic and closing behaviour of the valve body relative to the valve seat can be determined by selecting the size of said opening. With a large opening or several openings, the vacuum will be removed more quickly, in particular during the aeration of a vacuum container. A smaller opening has the advantage that if powder products, for example, are packed in a container, the risk of dust formation from powder is lower on removal of the vacuum. Where the surface of the openings is larger, vacuum can be applied more quickly with the use of vacuum pumps, because throttling losses are less.

The size of the openings in question will be selected depending on the application, and in particular the speed of aeration.

The hinged connection and the valve body can be made of a single plastic material. An appropriate plastic material will be selected depending on the application, and elastomeric materials can also be used.

If the opening to be shut off is of some size, it may be advantageous to make the valve body hollow, in order to retain the elastic character of the valve body and to save material.

The invention also relates to the shutoff valve which can be realised by combination of the valve body described above and the valve seat described above, or any other valve seat.

BRIEF DESCRIPTION OF THE DRAWINGS

The invention will be described in greater detail below with reference to an exemplary embodiment illustrated in the drawing, in which.

DESCRIPTION OF THE PREFERRED EMBODIMENTS

Figure 1:
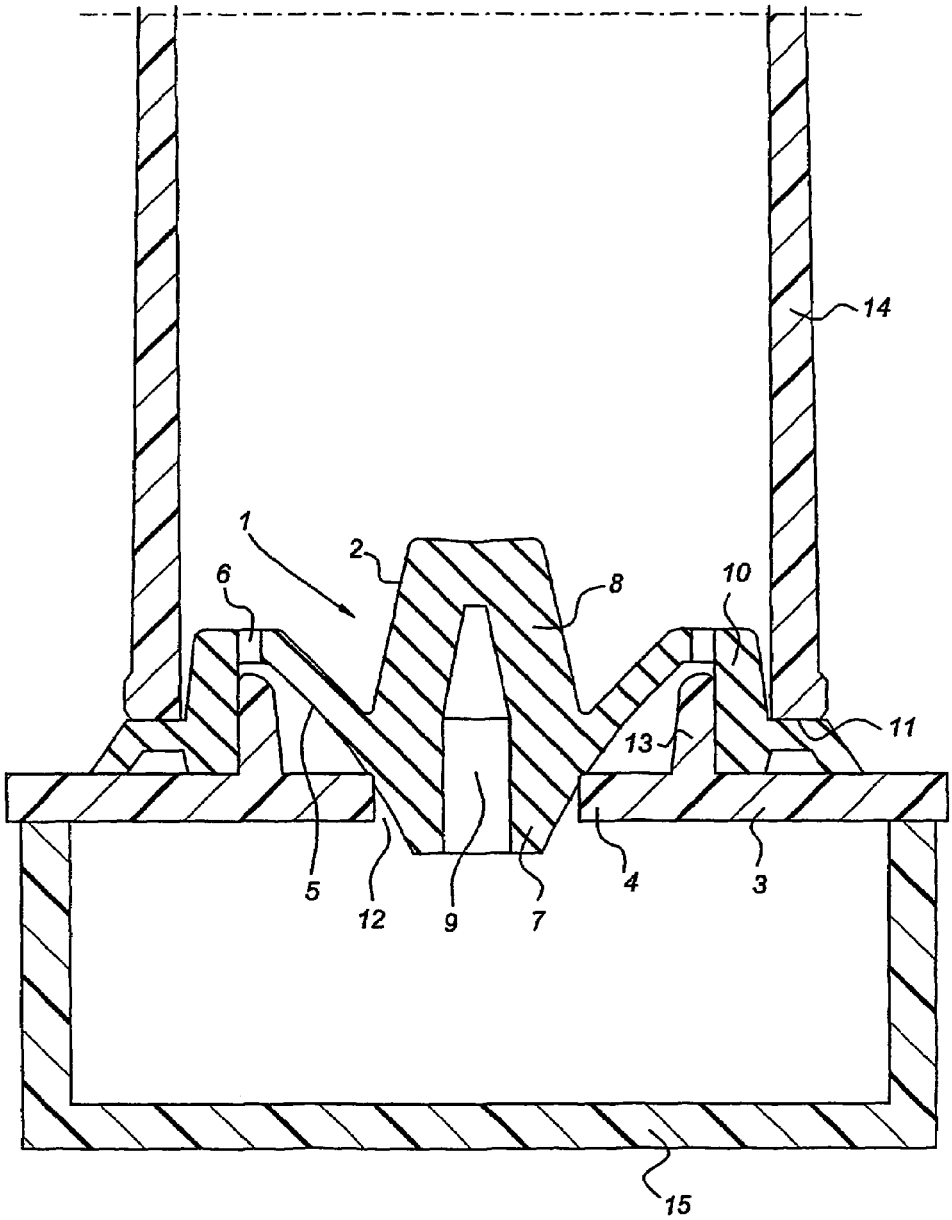
FIG. 1 shows diagrammatically a cross section of a first embodiment of the shutoff valve according to the invention, in the closed position.

A shut-off valve according to the invention, shown as an example, is indicated by 1 in the figures. This valve is composed of a valve body 2. A container 3 is present, provided with a valve seat 4 bounding an opening 12. Valve body 2 comprises a stop shaped closing part 7, a scaling connecting part 5, and a clamping edge 10. Closing part 7 is connected by way of a sealing connecting part 5 extending all the way round, and by way of clamping edge 10, to raised edge 13 of container 3. Both the valve body and the connecting part are made of a material that is relatively flexible, while the container 3 is made of a relatively rigid material. Further sealing is achieved by shut-off valve edge 11 of the connecting part 5. The connecting part 5 is of a resilient design, which provides for the return movement of the valve body 2 during pumping. Openings 6 are present in the connecting part. A cavity 9 is bounded in the conical closing part 7. Above the connection to the connecting pad 5 is an operating part 8, likewise conical, but then tapering in the other direction.

The shut-off valve, and more particularly closing part 7 and connecting part 5, are designed in such a way that in the unloaded state conical closing part 7 rests in a substantially sealing manner against valve seat 4, i.e. against the circumferential edge of opening 12. This means that some vacuum (pre-suck) is immediately present, for example on pressing the operating part. This contrasts with a variant in the case of which the closing part 7 is moved towards valve seat 4 only through the application of vacuum. Vacuum can be applied by means of a vacuum pump generally known in the prior art, only a part of which pomp is shown in FIG. 1 and indicated by 14. If this part is placed on shut-off edge 11, a seal is produced by means of said shut-off edge 11 and clamping edge 10. Below shut-off edge 11 is a cavity, so that an optimum seal is provided between part 3, on the one hand, and part 14, on the other hand, even if part 14 is not positioned entirely correctly. If vacuum is them applied, the closing part 7 of seat 4 will be lifted. Gas moves out of the container 15 situated below the valve body 2, by way of openings 6 to pump 14. Depending on the size and the number of openings 6, a more or less pronounced throttling effect occurs. It will be understood that other types of vacuum pumps, hoses and the like, which act in a different way on the container, or the connecting part, to produce a seat, can be provided.

Figure 2:
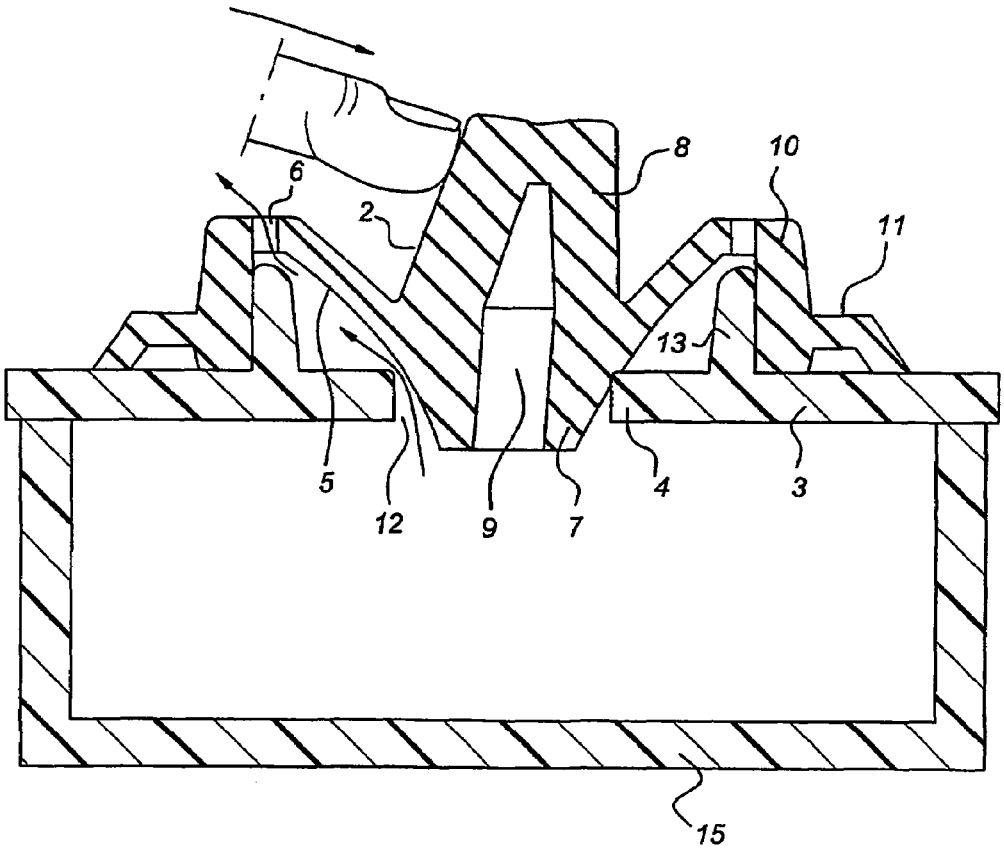
FIG. 2 shows the shut-off valve according to FIG. 2 during its opening by the user.

For the aeration of the container 15, the operating part 2 can be pressed away laterally, as shown in FIG. 2. The elastic properties of the connecting part 5 and also the fact that the valve body 2 is soft near the valve seat 4 meats that some tilting and deformation of the closing part 7 occur while the operating part 8 is being pushed away laterally. This produces an opening, and air can be supplied through openings 6 and this opening, so that aeration occurs. Here too, the total surface area of the openings 6 is important for the speed of aeration. It will be understood that the diameter of opening 12, the conicity of closing part 7 on seat part 4, and the hardness of the material are parameters that can be varied, depending on the application of the shut-off valve, and more particularly the desired vacuum. According to an advantageous embodiment, the angle of taper, in other words the angle that the external surface of the operating part 7 makes with the face of the opening 12, is approximately 45°, but it can vary within a broad range. A smaller valve angle, in other words a less tapering cone, makes the movement difficult, or requires a greater movement for a particular opening of the shut-off valve. A greater angle can give rise to problems with the sealing effect of the valve body relative to the valve seat.

Valve seat 4 is preferably rounded. A value of 0.5 mm is mentioned as an example of the radius of curvature. At this value there is virtually no risk of damage to the valve body, and the sealing cock is optimized.

Figure 3:
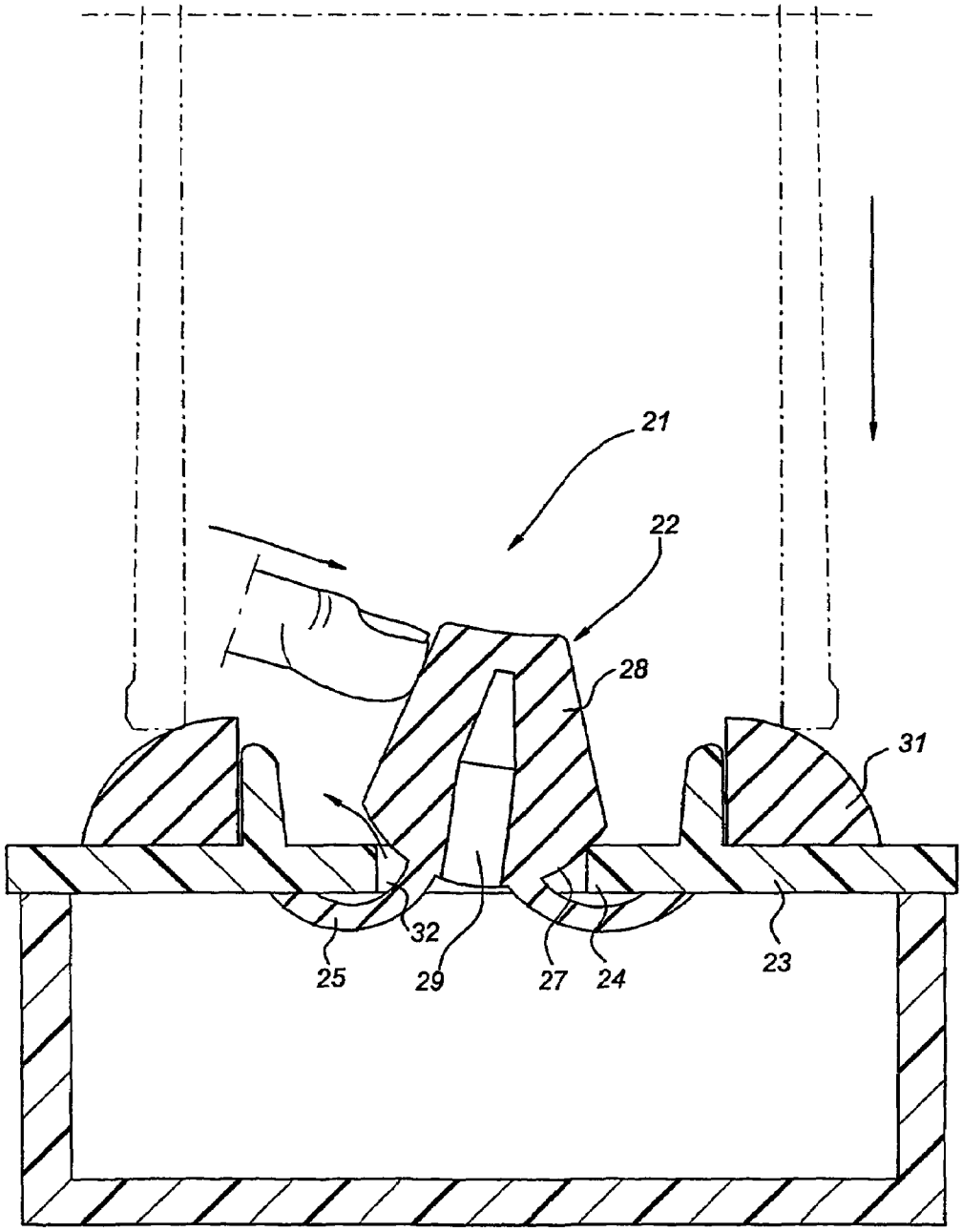
FIG. 3 shows diagrammatically in cross section a further embodiment of the invention.

FIG. 3 shows a variant of the shut-off valve illustrated in FIGS. 1 and 2. The shut-off valve is indicated in its entirety by 21. The valve body is indicated by reference numeral 22, and the operating part is indicated by 28. Unlike the embodiment described above, the closing part 27 is no longer conical, but of a spherical design. Valve seat 24 can be embodied in the manner described above. The connection between the spherical closing part and container 23 is realised by means of a number of fingers 25 distributed around the circumference. A cavity 29 is also present in this embodiment, which cavity saves material and facilitates movement. Engagement between the cylindrical wall—indicated by dotted lines—of the vacuum pump and shut-off valve 21 is by means of a spherical part provided with a shut-off edge 31.

The spherical shape makes it possible to fit the vacuum-pump in a slightly tilted position, while sufficient sealing effect is still ensured.

The spherical design of shut-off part 27 is intended still to provide full scaling even in the case of slight movement. In other words, aeration occurs solely through deformation, and air can flow out by way of the opening 32 created in that way.

The embodiment described above is such that during the typical use of a hand-operated vacuum pump the valve body rises approximately 0.1 mm from the valve seat. It will be understood that this value can also vary. Through the vacuum applied and the conical shape of the shut-off part, ever-increasing contact pressure will be achieved between valve body and valve seat, with the result that the scaling effect constantly increases.

Figure 4:
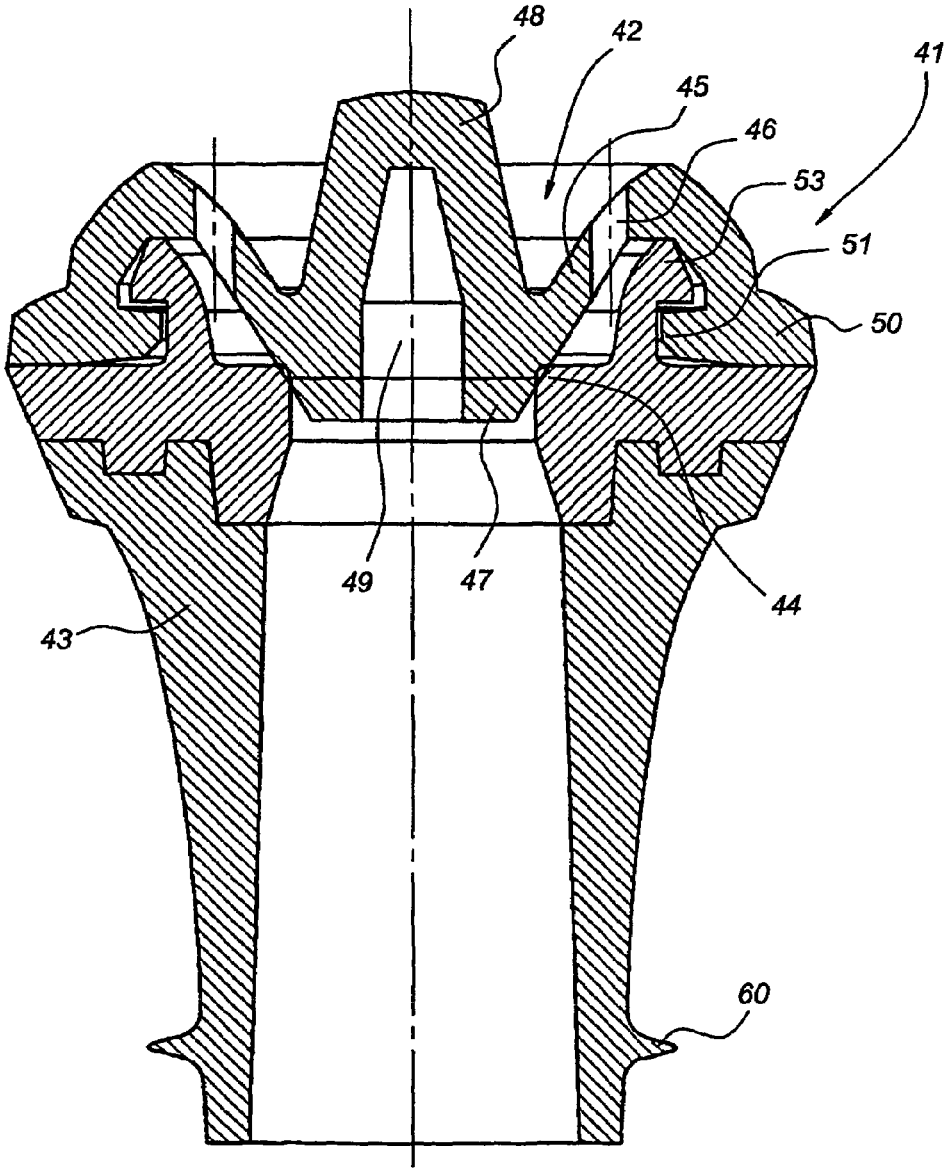
FIG. 4 shows diagrammatically in cross section a modified embodiment of the invention.

FIG. 4 shows a further variant of the invention, which is suitable in particular for application is combination with bottles. It is indicated in its entirety by 41. The valve body is indicated by 42 and is composed of a closing part 47 and an operating part 48 situated in line with it. The connection to the clamping edge 50 is achieved by way of the connecting part 45, which extends all the way round and contains openings 46. This connection connects to the transition between closing part 47 and operating part 48.

The closing part 47 is provided with a cavity 49. Clamping edge 50 is provided with an inward projecting edge 51, which interacts with an outward projecting edge 53 of valve seat 44. Valve seat 44 is made of a relatively hard material and is connected to a neck part 43, which is made of a relatively supple, deformable material. This neck part is designed to be fitted in a bottle.

In order to prevent dislodging, the peripheral edge 60 is present, while the actual seal is achieved relative to the bottle by the curved part of neck part 43.

Although the invention is described above with reference to two preferred embodiments persons skilled in the art will understand immediately on reading this description that there are many further variants of applications and variants of embodiments. These lie within the scope of the appended claims.

What is claimed is:

1. Valve body (2, 22, 42), comprising a plug-shaped closing part (7, 27, 47) with a closing face, and a fixing part (11, 51) which surrounds the closing part and is hingedly connected to the closing part, an extension (8, 28, 48) acting as an operating part being fitted on the closing part in the direction away from the closing face, wherein said hinged connection to the fixing part is designed in such a way that on engagement upon the operating part the closing face carries out a tilting movement, characterised in that said closing part is the closing part of a vacuum valve and said fixing part and/or said connection is/are provided with an opening (6, 46) for releasing vacuum, in which said closing face comprises a conical surface.

2. Valve body according to claim 1, in which the center of said tilting movement lies substantially on the longitudinal axis of the closing part operating means.

3. Valve body according to claim 1, connected by way of an elastic connection (5,25,45) to said fixing part (11).

4. Valve body according to claim 1, in which said closing part is provided with a cavity (9,29,49) facing said closing face.

5. Valve body according to claim 1, comprising a hardness between 35 and 45 shore.

6. Shut-off valve, comprising the valve body according to claim 1, and a valve seat (4, 24, 44), in which the valve seat comprises a relatively hard material and said valve body comprises a relatively soft, deformable material.

7. Shut-off valve according to claim 6, in which said connection is designed to press said valve body in the unloaded state against said valve seat.

8. Valve body comprising a plug-shaped closing part (7, 27, 47) with a closing face, and a fixing part (11, 51) which surrounds the closing part and is hingedly connected to the closing part, an extension (8, 28, 48) acting as an operating art being fitted on the closing part in the direction away from the closing face, wherein said hinged connection to the fixing part is designed in such a way that on engagement upon the operating part the closing face carries out a tilting movement, characterised in that said closing part is the closing part of a vacuum valve and said fixing part and/or said connection is/are provided with an opening (6, 46) for releasing vacuum, comprising a single piece of material.

9. Valve body according to claim 8, in which said closing face comprises a conical surface.

10. Shut-off valve, comprising the valve body according to claim and a valve seat (4,24,44), in which the valve seat comprises a relatively hard material and said valve body comprises a relatively soft, deformable material.

11. Shut-off valve according to claim 10, in which said fixing part comprises a circumferential edge with circumferential groove and said valve seat has a circumferential edge with circumferential projection (53).

12. Shut-off valve according to claim 10, in which said connection is designed to press said valve body in the unloaded state against said valve seat.

13. Shut-off valve according to claim 11, in which said connection is designed to press said valve body in the unloaded state against said valve seat.

14. Shut-off valve, comprising the valve body according to claim 8, and a valve seat (4, 24, 44), in which the valve seat comprises a relatively hard material and said valve body comprises a relatively soft, deformable material.

15. Shut-off valve according to claim 14, in which said fixing part comprises a circumferential edge with circumferential groove and said valve seat has a circumferential edge with circumferential projection (53).

16. Shut-off valve according to claim 14, in which said connection is designed to press said valve body in the unloaded state against said valve seat.

17. Shut-off valve according to claim 15, in which said connection is designed to press said valve body in the unloaded state against said valve seat.

18. Shut-off valve with a valve body comprising a plug-shaped closing part (7, 27, 47) with a closing face, and a fixing part (11, 51) which surrounds the closing part and is hingedly connected to the closing part, an extension (8, 28, 48) acting as an operating part being fitted on the closing part in the direction away from the closing face, wherein said hinged connection to the fixing part is designed in such a way that on engagement upon the operating part the closing face carries out a tilting movement, characterised in that said closing part is the closing part of a vacuum valve and said fixing part and/or said connection is/are provided with an opening (6, 46) for releasing vacuum, in which said fixing part comprises a circumferential edge with circumferential groove and said valve seat has a circumferential edge with circumferential projection (53).

19. Shut-off valve according to claim 18, in which said connection is designed to press said valve body in the unloaded state against said valve seat.

* * * * *